US007047681B2

(12) United States Patent
Perelli et al.

(10) Patent No.: US 7,047,681 B2
(45) Date of Patent: May 23, 2006

(54) FOLDING SIGN

(75) Inventors: Thomas Perelli, Winchester, VA (US); Eric Bennett, Winchester, VA (US); Kevin Fitzpatrick, Winchester, VA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 52 days.

(21) Appl. No.: 10/629,705

(22) Filed: Jul. 30, 2003

(65) Prior Publication Data

US 2004/0107619 A1 Jun. 10, 2004

Related U.S. Application Data

(60) Provisional application No. 60/399,128, filed on Jul. 30, 2002.

(51) Int. Cl.
*G09F 15/00* (2006.01)

(52) U.S. Cl. ..... 40/610; 116/63 P

(58) Field of Classification Search ..... 40/610, 40/612; 116/63 C, 209, 63 P, 63 T; 248/165, 248/175

See application file for complete search history.

(56) References Cited

U.S. PATENT DOCUMENTS

| | | | | |
|---|---|---|---|---|
| 2,483,734 | A | 10/1949 | Neal | |
| 2,887,983 | A | 5/1959 | Budd | |
| 3,200,786 | A | 8/1965 | Swezy et al. | |
| 3,262,415 | A | 7/1966 | Biscardi | |
| 3,291,096 | A | 12/1966 | Walter | |
| 3,334,856 | A | 8/1967 | Corey | |
| 3,364,600 | A | 1/1968 | Patterson | |
| 3,777,428 | A | 12/1973 | Caufield | |
| 3,800,735 | A | 4/1974 | Simpson | |
| 3,922,998 | A | 12/1975 | May | |
| 4,038,769 | A | 8/1977 | Werner | |
| 4,055,840 | A | 10/1977 | Uchytil et al. | |
| 4,085,762 | A | 4/1978 | O'Brian et al. | |
| 4,209,928 | A | 7/1980 | Kraayvanger | |
| 4,253,260 | A | 3/1981 | Maza et al. | |
| 4,256,050 | A | 3/1981 | Barnard | |
| 4,426,801 | A | 1/1984 | Gates | |
| 4,462,145 | A * | 7/1984 | Schulze | 29/428 |
| 4,471,548 | A | 9/1984 | Goudie | |
| 4,516,344 | A | 5/1985 | Seely | |
| 4,516,620 | A | 5/1985 | Mulhern | |
| 4,592,158 | A | 6/1986 | Seely | |

(Continued)

FOREIGN PATENT DOCUMENTS

| | | |
|---|---|---|
| CH | 374576 | 1/1964 |

(Continued)

OTHER PUBLICATIONS

Jon-Don Handy Cone Wet Floor Sign, Janitorial, Floor Signs, http://jon-doninc.com/catalog/product_info.php?products_ id=9530.

*Primary Examiner*—Cassandra Davis
(74) *Attorney, Agent, or Firm*—Foley & Lardner LLP

(57) ABSTRACT

The present invention relates to a sign that can be folded. The folding sign includes a flexible cover having at least one surface for displaying information, such as hazard symbols or words. The flexible cover is supported by a supporting device that is configured to move between a closed or folded position to an open position. The support device also enables the folding sign to move to a collapsed position. The folding sign additionally includes connecting mechanisms that enable the flexible cover to release as the folding sign moves into the collapsed position.

21 Claims, 14 Drawing Sheets

U.S. PATENT DOCUMENTS

| | | | | |
|---|---|---|---|---|
| 4,796,369 | A | | 1/1989 | Hamann |
| 4,817,318 | A | | 4/1989 | Strauch |
| 4,848,263 | A | | 7/1989 | Grimm |
| 4,875,302 | A | | 10/1989 | Noffsinger |
| 4,915,332 | A | * | 4/1990 | Ouellette ..... 248/171 |
| 5,046,274 | A | | 9/1991 | David |
| 5,199,375 | A | | 4/1993 | Johson |
| 5,225,254 | A | | 7/1993 | Foulke |
| 5,287,822 | A | | 2/1994 | Anderson |
| 5,337,947 | A | | 8/1994 | Eskandry |
| 5,347,737 | A | | 9/1994 | Theobald, III |
| 5,371,964 | A | | 12/1994 | Kubacki et al. |
| 5,442,871 | A | | 8/1995 | Sarkisian et al. |
| 5,489,077 | A | | 2/1996 | Stoudt |
| 5,551,178 | A | | 9/1996 | Foley et al. |
| 5,561,931 | A | | 10/1996 | Duenkel |
| 5,667,175 | A | | 9/1997 | Brady |
| 5,675,923 | A | | 10/1997 | Sarkisian et al. |
| 5,746,406 | A | | 5/1998 | Dicke et al. |
| 5,775,253 | A | | 7/1998 | Quan et al. |
| 5,791,077 | A | | 8/1998 | Felber |
| 5,884,424 | A | * | 3/1999 | Smith ..... 40/610 |
| 5,895,024 | A | | 4/1999 | Williams et al. |
| 5,950,969 | A | | 9/1999 | Bennett et al. |
| 6,111,621 | A | * | 8/2000 | Kim et al. ..... 349/54 |
| 6,119,621 | A | | 9/2000 | Johnson |
| 6,139,122 | A | | 10/2000 | Johnson |
| 6,164,005 | A | | 12/2000 | Copeland |
| 6,199,504 | B1 | | 3/2001 | Freeman |
| 6,237,268 | B1 | | 5/2001 | Levin |
| 6,244,011 | B1 | | 6/2001 | Esser |
| 6,332,284 | B1 | | 12/2001 | Tafforeau |
| 6,389,721 | B1 | | 5/2002 | Yang |
| 2002/0095842 | A1 | | 7/2002 | Wenz et al. |

FOREIGN PATENT DOCUMENTS

| | | |
|---|---|---|
| DE | 1 188 988 | 12/1959 |
| EP | 0 352 386 A1 | 1/1990 |
| GB | 1 395 169 | 5/1975 |
| GB | 2286618 A | 8/1995 |

* cited by examiner

FOLDING SIGN

CROSS-REFERENCES TO RELATED APPLICATIONS

This application claims the benefit of U.S. Provisional Application No. 60/399,128, filed Jul. 30, 2002.

BACKGROUND OF THE INVENTION

1. Field of the Invention

The present invention relates to a sign and, more particularly, to a sign that can be folded.

2. Description of Related Art

Traditionally, folding signs have been placed in areas to convey messages regarding hazardous conditions. For example, safety signs that display a "CAUTION" warning have been used to inform store patrons of hazardous or unusual surface conditions, such as a non-toxic spill. Safety signs that display a "DANGER" warning have been used where conditions are imminently hazardous and may result in death or serious injury if not avoided.

A conventional safety sign can take the shape of a rigid, freestanding cone or pyramid that can be manually folded and automatically reopened by means of a mechanical device. This conventional safety sign includes a flexible covering, such as nylon, for displaying a hazard message. When folded, the conventional safety sign can be slid into a tube-like holder for storage. The tube-like holder typically includes means for mechanical attachment to a vertical surface. For example, the holder may be attached to a pole in a spill-prone area on a grocery store aisle. This enables a store employee responding to a hazard in the area to quickly retrieve and deploy the safety sign.

This conventional safety sign has significant disadvantages. Safety signs of this type have been misplaced. Deployed safety signs have been pushed away from spills by passersby and grocery carts, and store employees fail to return safety signs to their designated holders after use. Also, wall-mounted storage holders have become detached. When safety signs are missing from their designated storage holders or the storage holders are missing, hazardous conditions cannot be quickly and efficiently marked.

Another disadvantage of the conventional safety sign is that it is awkward to handle. The conical or pyramidal shape of the safety sign and the flexible—often slick—fabric covering can make the safety sign difficult to carry and position, particularly when the user is trying to maneuver around a hazardous condition.

Additionally, the conventional safety sign placed on a floor, for example, in a grocery store, can pose a significant hazard to customers who are not paying attention. For example, a customer who slips on a wet surface or trips over a conventional safety sign may fall directly on the sign, impacting the top of the cone or pyramid. The customer may experience an injury, even an internal injury, because conventional safety signs have a somewhat pointed tip at the top.

SUMMARY OF THE INVENTION

An aspect of the present invention relates to a folding sign. The folding sign includes a flexible cover having at least one surface for displaying information, and a supporting device for supporting the flexible cover. The supporting device can be moved to a collapsed position. The folding sign further includes at least one connecting mechanism that connects the flexible cover to the supporting device. The at least one connecting mechanism is configured to permit the connection to release to allow the supporting device to move to the collapsed position.

Another aspect of the present invention relates to a folding sign. The folding sign includes a flexible cover that has at least one surface for displaying information, and support members that support the flexible cover. The folding sign also includes a folding mechanism. The folding mechanism has a block member and a plurality of coil springs. Each coil spring is connected on one end to the block and on the other end to a corresponding support member. The coils springs are configured to be displaced in a latitudinal direction to permit movement of the support members from an open position to a closed position and to permit movement of the support members to a collapsed position upon application of a predetermined force to the sign.

Yet another aspect of the present invention relates to a folding sign. The folding sign includes a flexible cover that has at least one surface for displaying, information and a supporting device that supports the flexible cover. The folding sign also includes a handle. The handle is located at the top of the folding sign and has an informational area for displaying information.

Yet another aspect of the present invention relates to a method of using a folding sign. The method includes providing a folding sign that has an area for displaying location-identifying information, providing a storage container into which the folding sign can be inserted for storage, associating the storage container with a location, associating the folding sign with the storage container, and displaying information identifying the location on the area of the folding sign.

BRIEF DESCRIPTION OF THE DRAWINGS

The accompanying drawings, which are incorporated in and constitute a part of this specification, illustrate a preferred embodiment of the invention and together with the description, serve to explain principles of the invention.

DETAILED DESCRIPTION OF PREFERRED EMBODIMENT

Figure 1:
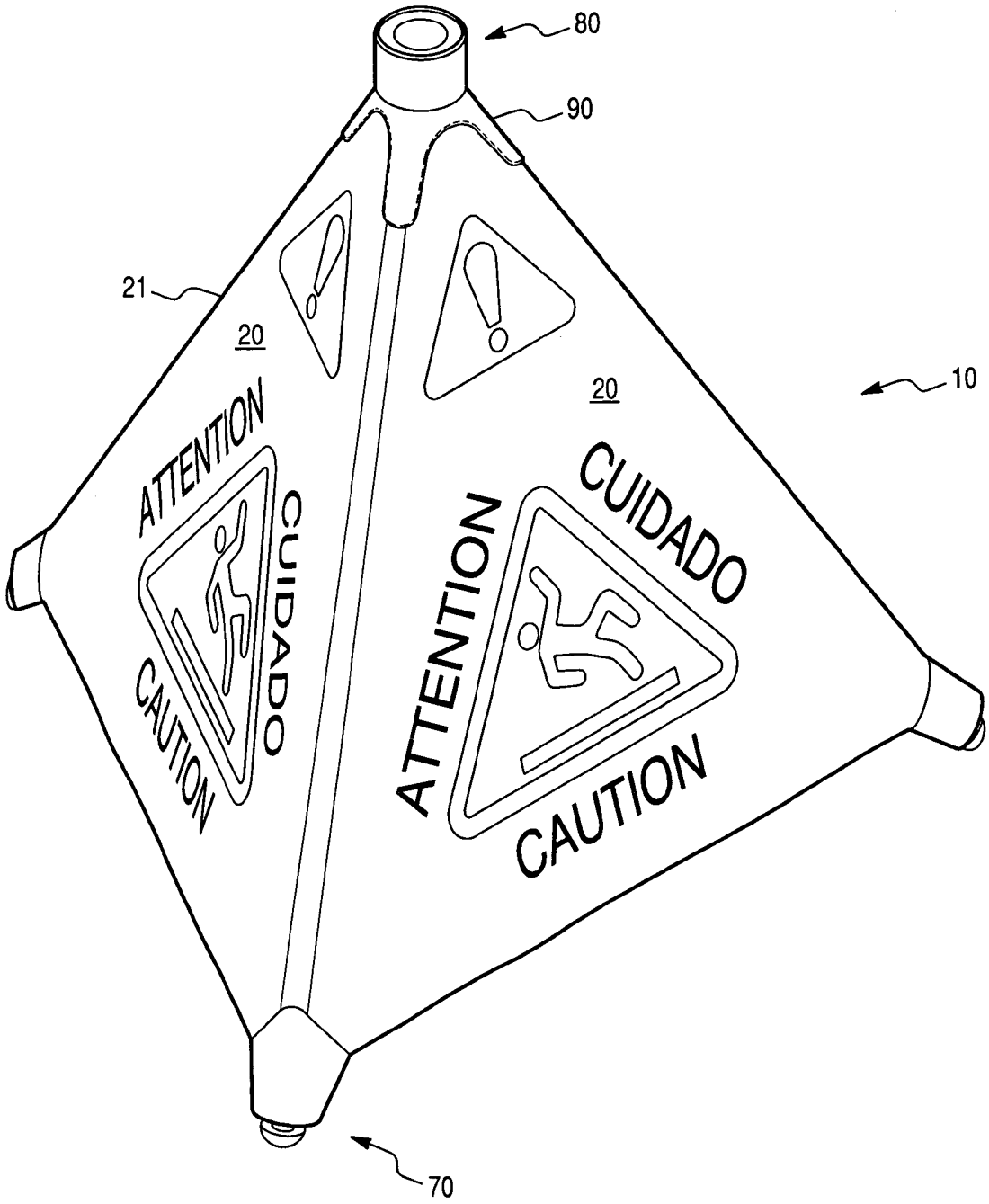
FIG. 1 is a perspective view of an embodiment of a folding sign according to the present invention.
Figure 2:
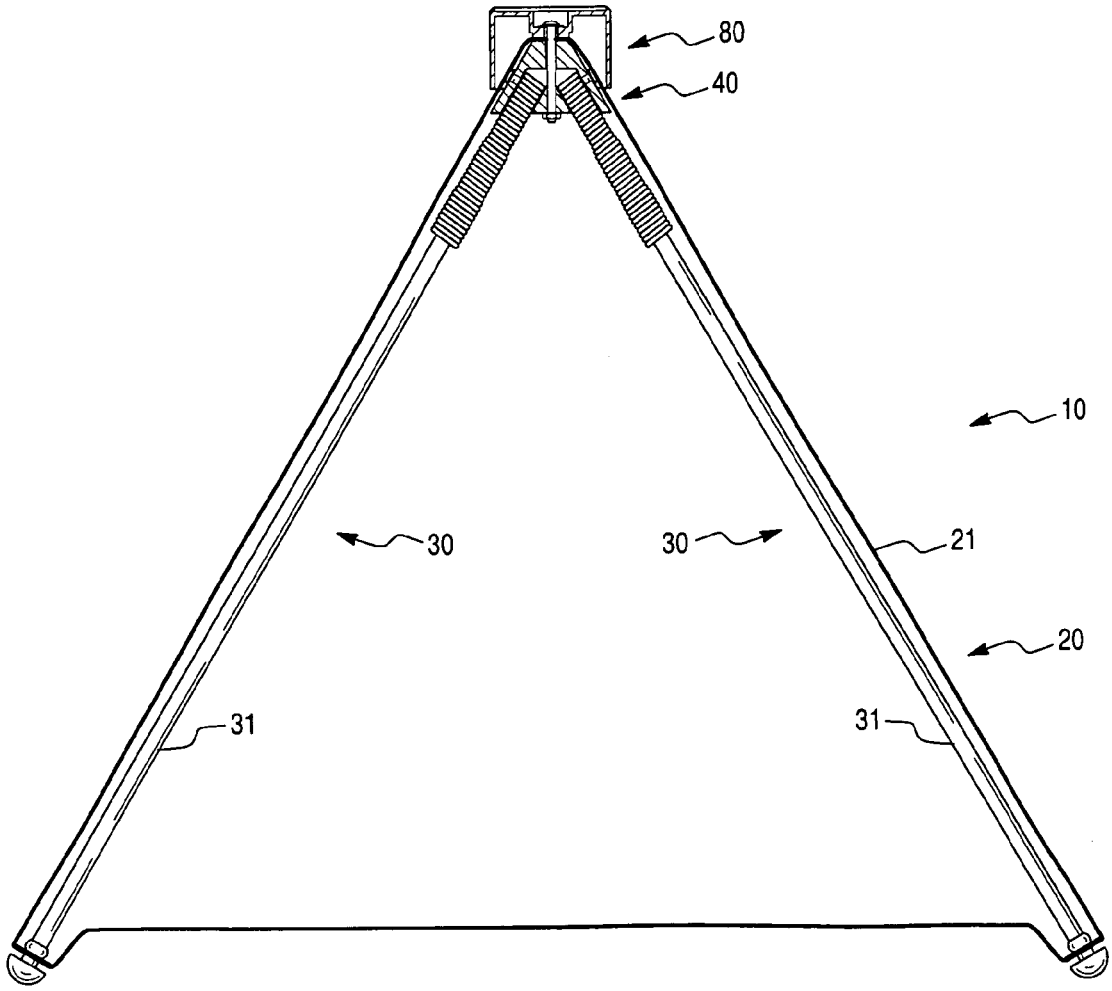
FIG. 2 is a partial cross-sectional view of the folding sign of FIG. 1.

Reference will now be made in detail to a presently preferred embodiment of the invention, an example of which is illustrated in the accompanying drawings. An effort has been made to use the same reference numbers throughout the drawings to refer to the same or like parts.

FIGS. 1 through 17 show a first preferred embodiment of a folding sign 10 according to the present invention. The folding sign 10 can be, for example, a safety sign. In this embodiment, the folding sign 10 preferably includes a flexible cover 20, a supporting device 30, and a folding mechanism 40.

The flexible cover 20 preferably includes a sheet of material 21. For example, the flexible cover 20 can be made of plastic material, such as nylon. The flexible cover 20 preferably is thin enough to make it lightweight yet sturdy enough to withstand repeated usage without breaking. The flexible cover 20 has at least one surface for displaying information, such as hazard symbols or words to warn of a hazard. Preferably the flexible cover 20 has three such surfaces. The flexible cover 20 preferably covers substantially the entire supporting device 30 and folding mechanism 40. The flexible cover 20 can also include a portion that extends along or partially along the bottom of the safety sign 10 to close off the bottom of the sign. By providing slits in the bottom of the safety sign are can enter and exit the safety sign during opening and closing of the sign.

The flexible cover 20 has an apex portion near the top of the folding sign 10 and preferably includes a shield 90 positioned on at least part of the apex portion (shown in FIG. 1). The shield 90 extends such that it covers upper ends of the legs 31. The shield 90 minimizes the possibility that the flexible cover 20 will catch when the folding sign 10 is inserted into a storage container 60. The shield 90 also provides a shield against wear of the flexible cover 20 incurred during insertion of the folding sign 10 into the storage container 60. The shield 90 is preferably made of plastic material that is thicker and smoother than the material of the flexible cover 20. The shield 90 can be affixed to the flexible cover 20, for example, by stitching. In the preferred embodiment, the shield 90 is a unitary member that is preferably positioned such that the apex of the shield 90 coincides with the apex of the folding sign 10.

The flexible cover 20 also may have lower shields 91 formed at bottom portions of the flexible cover 20. The lower shields 91 provide a stronger surface for connection to legs 31 of the supporting device 30. The lower shields 91 are preferably made of plastic material that is thicker and smoother than the material of the flexible cover 20. The lower shields 91 can be affixed to the flexible cover 20, for example, by stitching.

Figure 4:
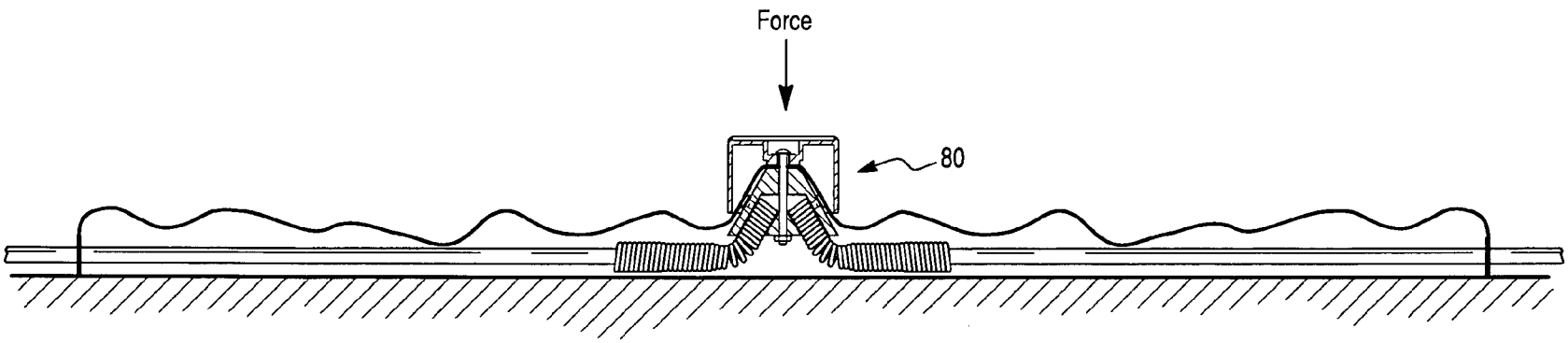
FIG. 4 is a partial cross-sectional view of the folding sign of FIG. 1 in a collapsed state.
Figure 5:
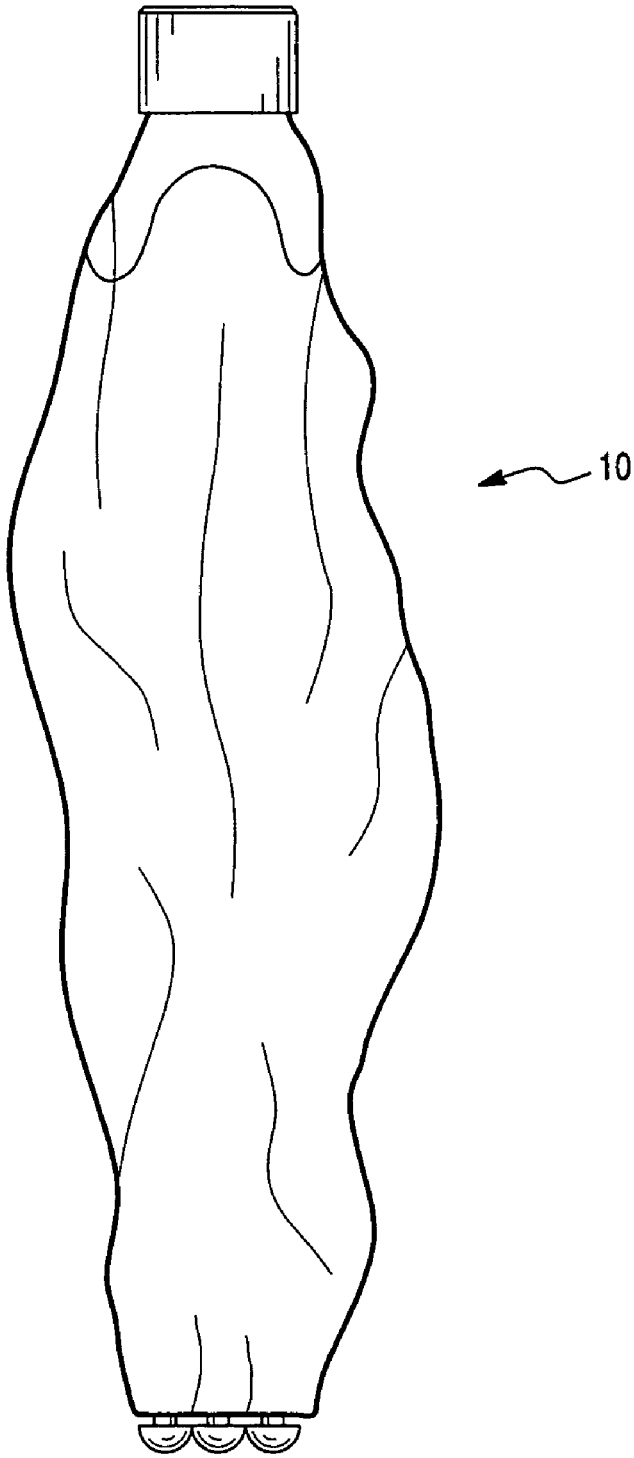
FIG. 5 is a side view of the folding sign of FIG. 1 in a closed position.

The supporting device 30 supports the flexible cover 20. The supporting device 30 is configured to move between a closed or folded position (shown in FIG. 5) and an open position (shown in FIG. 2). The supporting device 30 preferably facilitates support of the flexible cover 20 in the open position for display and in the closed position for storage. The supporting device 30 also can be moved to a collapsed position, as illustrated in FIG. 4.

The supporting device 30 preferably includes a plurality of legs 31. The legs 31 can be any conventional elongated structure, although they are preferably lightweight. Preferably the legs 31 are hollow, rod-like members formed of, for example, aluminum and having a length of approximately 18 inches and a diameter of approximately one quarter inch. The legs 31 can include feet 32 formed of, for example, plastic.

Figure 6:
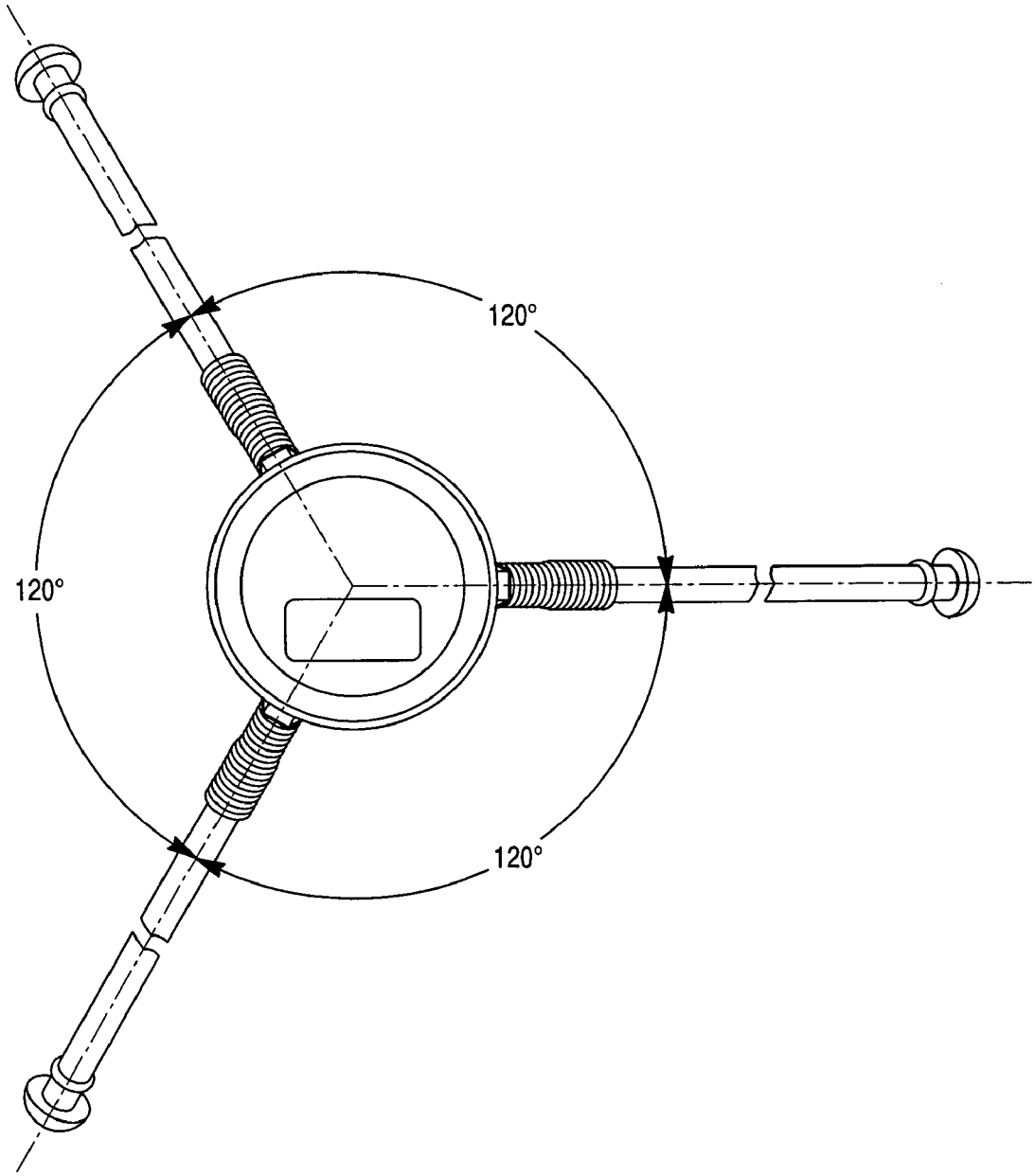
FIG. 6 is a top view of portions of the folding sign of FIG. 1.
Figure 7:
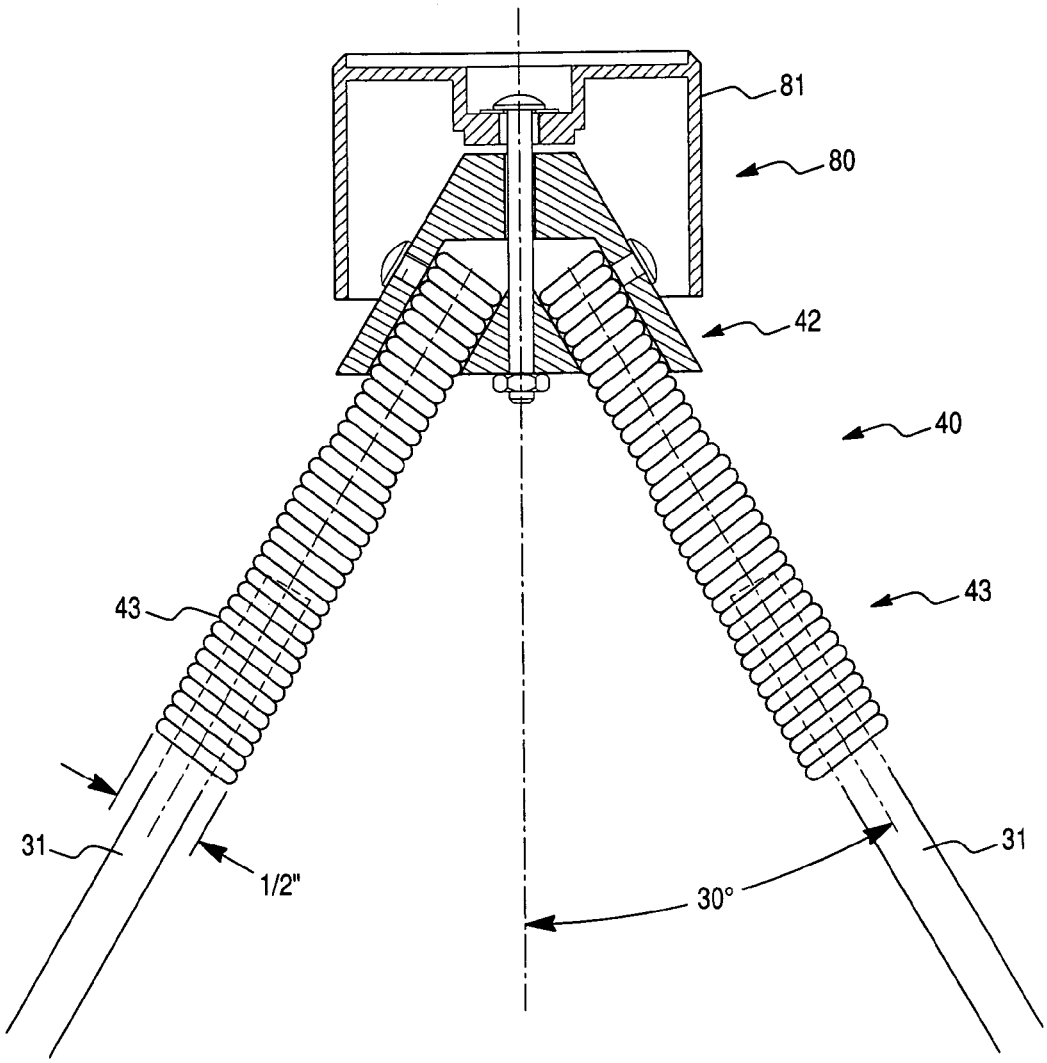
FIG. 7 is a partial cross-sectional view of the folding sign of FIG. 1.

The folding mechanism 40 enables the supporting device 30 to move from the open position to the closed position. The folding mechanism 40 also enables the supporting device 30 to collapse substantially flat on the ground upon application of a predetermined force to the folding sign 10. As shown in FIGS. 6 to 10, the folding mechanism 40 preferably includes a triangular block 42 and three coil springs 43. The block is preferably made of metal or plastic. One coil spring 43 is located at the top of each leg 31, with the top of each leg 31 partially fit into one end of the coil spring 43 and held together by an interference fit. As shown in FIGS. 6 and 7, the other end of the coil spring 43 fits into the block 42 at an angle of preferably about 30 degrees off vertical center and is held in place by a screw 44 extending through a hole in the block 42. The coil springs 43 preferably each have a stepped configuration. In other words, the diameter of the coil spring 43 changes along its length. The thinnest diameter (e.g. 0.367 inches) is at the top of the coil spring 43 and fits into the block 42. The largest diameter (e.g., 0.466 inches) is at the bottom and receives the leg 31 via a friction fit. The middle diameter (e.g., 0.430 inches) is at the middle and provides a transition between the smallest and largest diameters and prevents the leg 31 from sliding too far into the coil spring 43. The legs 31 are preferably about 120 degrees from each other on horizontal, as shown in FIG. 6.

Figure 8:
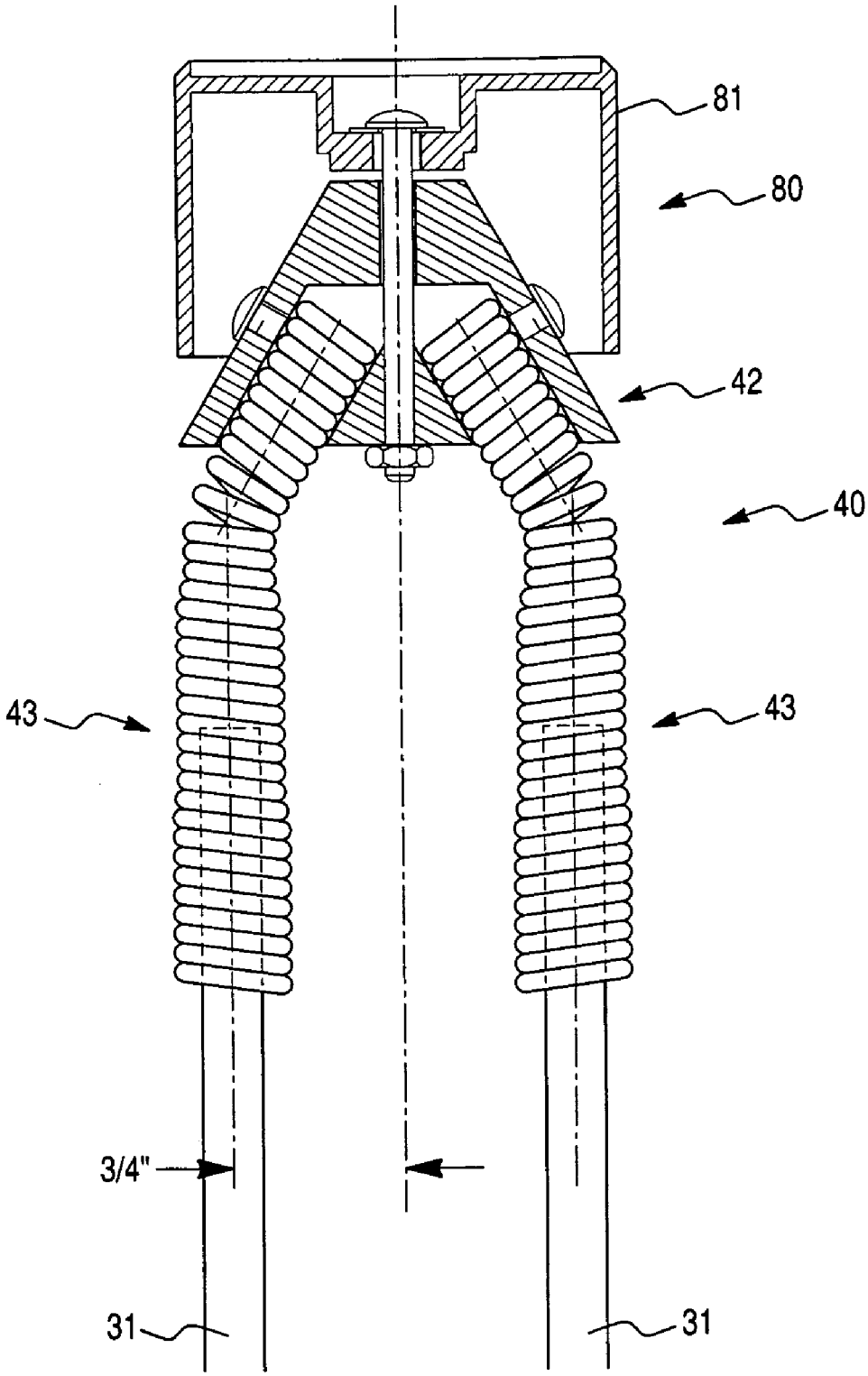
FIG. 8 is a partial cross-sectional view of the folding sign of FIG. 1.
Figure 9:
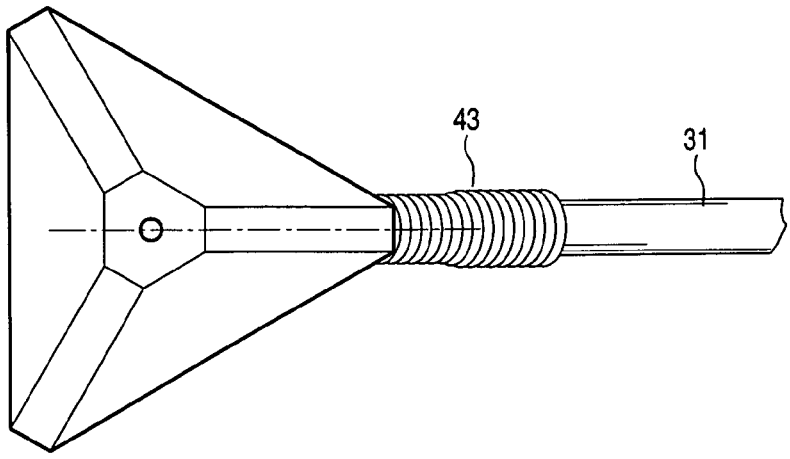
FIG. 9 is a top view of portions of the folding sign of FIG. 1.
Figure 10:
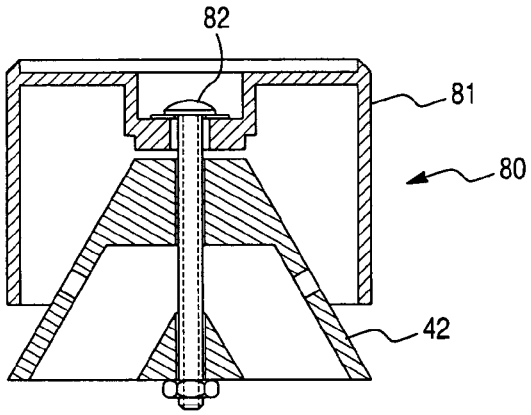
FIG. 10 is a cross-sectional view of portions of the folding sign of FIG. 1.

As a user manually moves the legs 31 toward the folded position, the coil springs 43 bend laterally along their lengths. In other words, the coil springs 43 are displaced in a latitudinal direction as shown in FIG. 8. In the closed or folded position, the coil springs 43 are under tension, biasing the folding sign 10 toward the open position. When the legs 31 in the closed or folded position are released from constraints, the coil springs 43 will try to straighten out to their fixed 30 degree angle off vertical center, in turn, automatically opening the flexible cover 20 of the folding sign 10.

Figure 3:
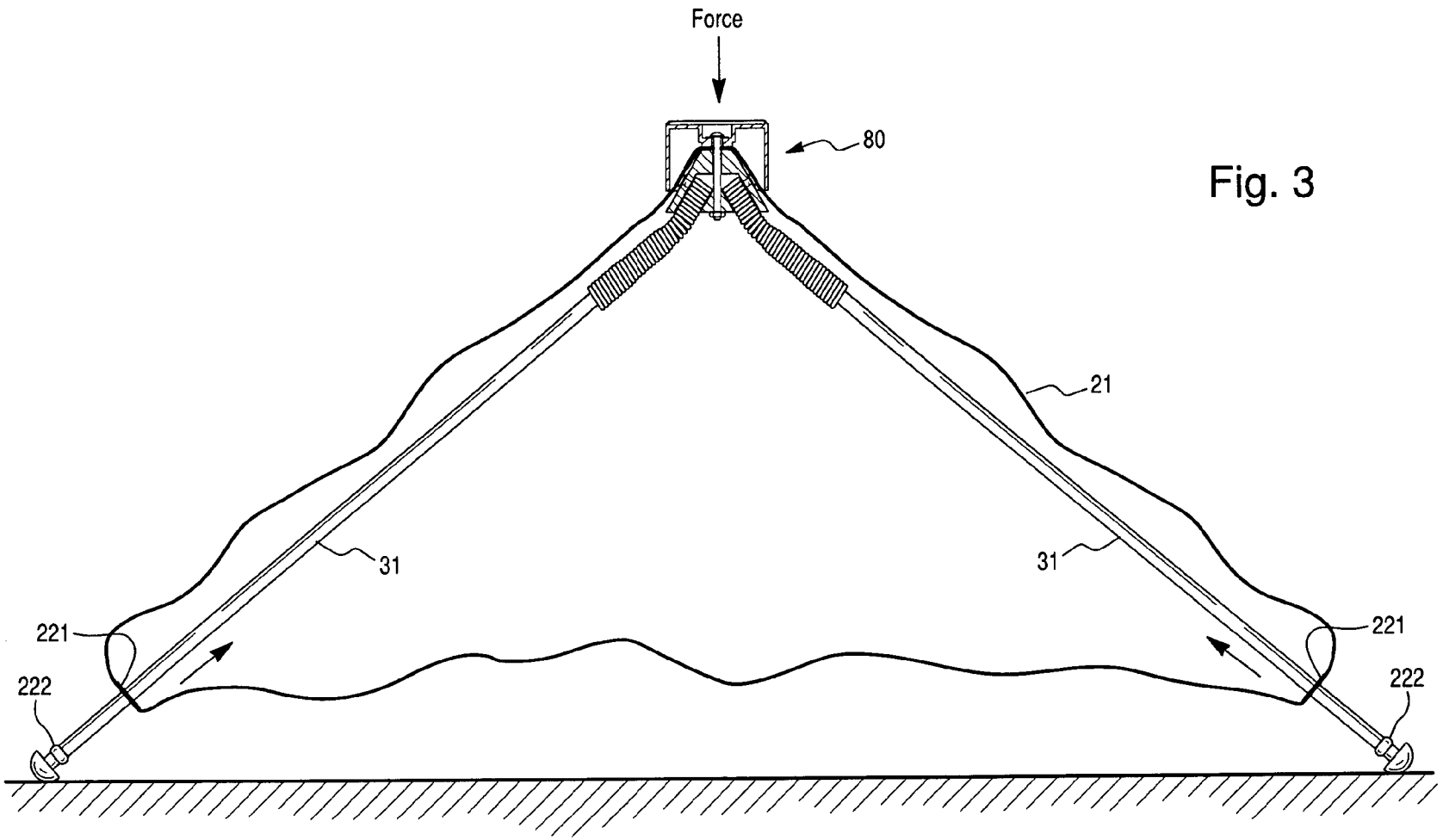
FIG. 3 is a partial cross-sectional view of the folding sign of FIG. 1 in a partially collapsed state.

Additionally, the folding mechanism 40 preferably enables the folding sign 10 to collapse substantially flat on the ground if someone falls directly on top of it. As shown in FIG. 3, if someone falls on the folding sign 10, the impact imparts a force, F, to the top of the folding sign 10. Upon application of a predetermined force to the top of the folding sign 10, the coil springs 43 flex and the legs 31 rotate up about 60 degrees, enabling the supporting device 30 to collapse to the ground (FIG. 4). This feature is intended to prevent an injury to someone falling on the folding sign 10.

Figures 13, 13A:
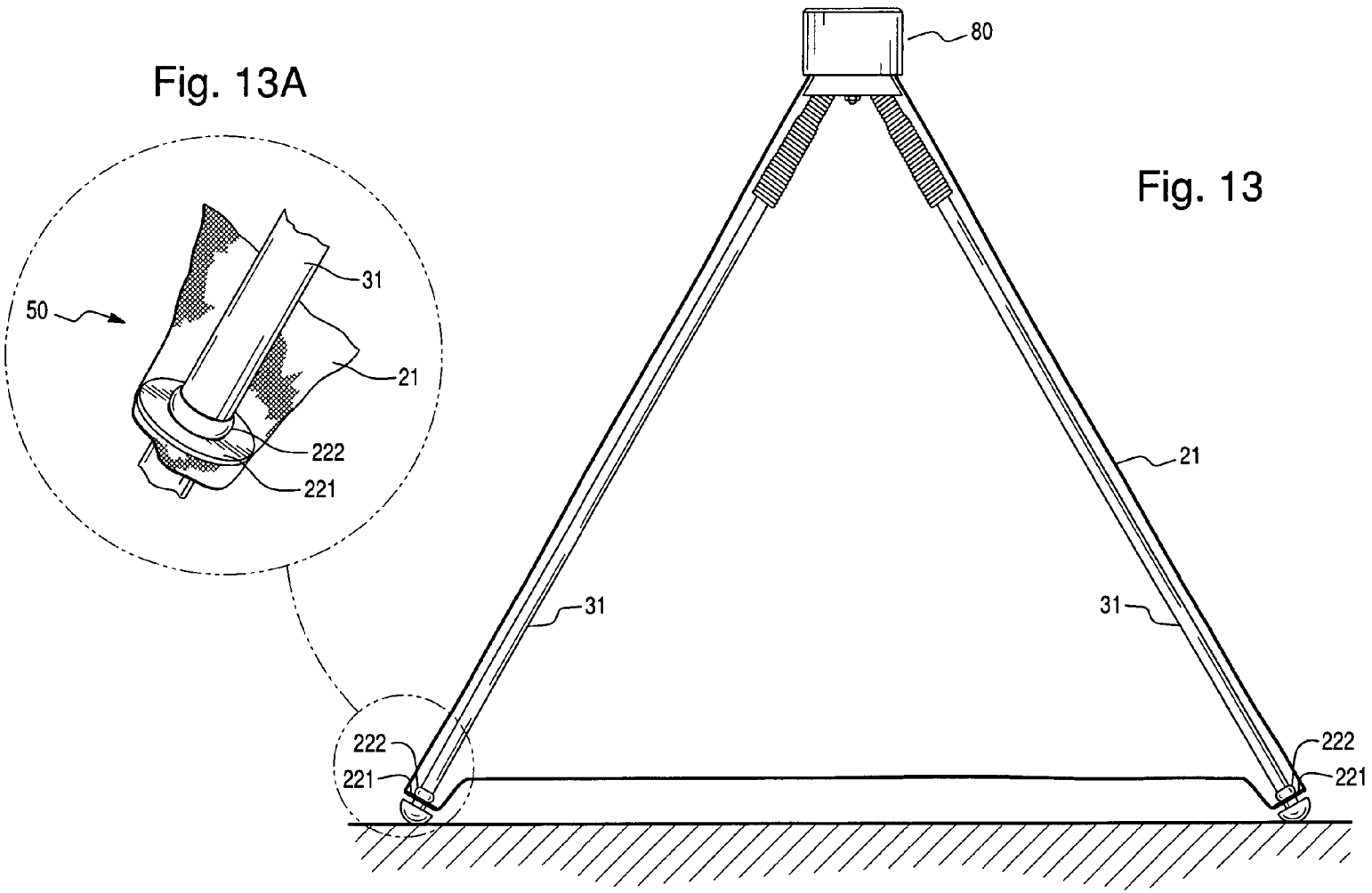
FIG. 13 is a partial cross-sectional view of the folding sign of FIG. 1.
FIG. 13A is a perspective view of portions of the folding sign of FIG. 1.
Figure 14:
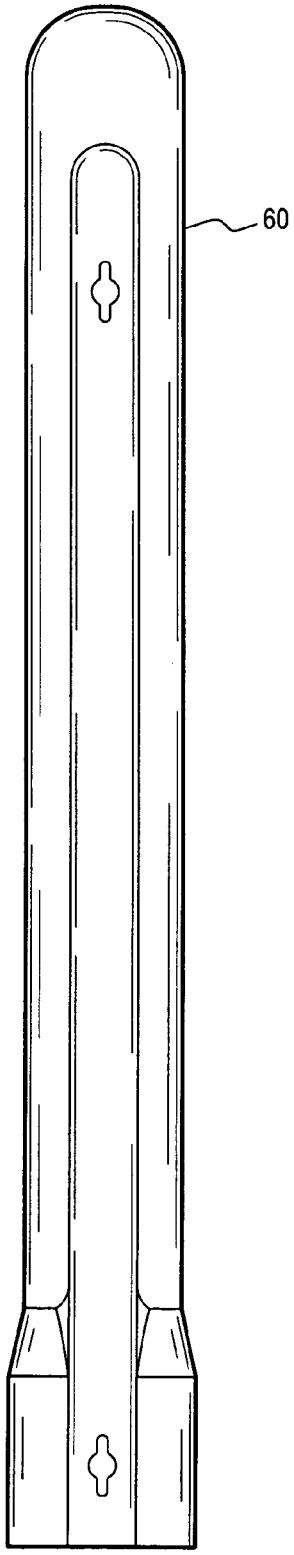
FIG. 14 is a rear view of a container for the folding sign of FIG. 1.
Figure 15:
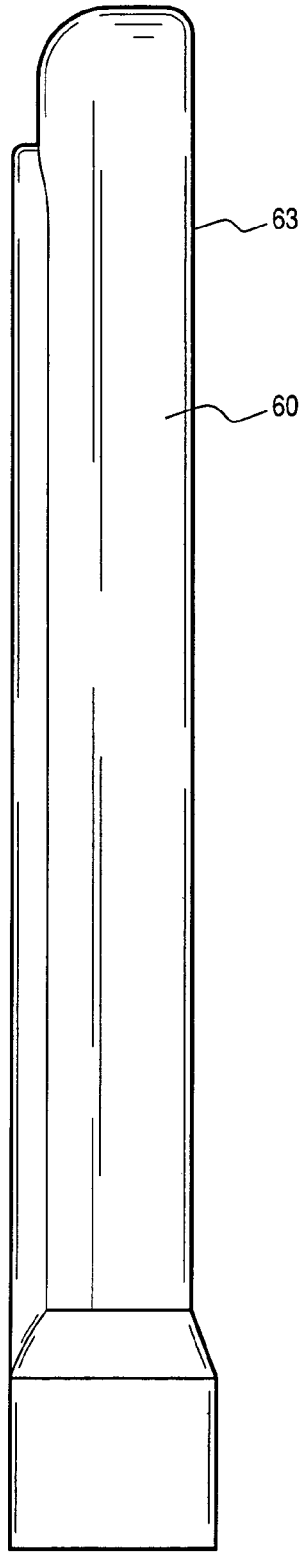
FIG. 15 is a side view of the container for the folding sign of FIG. 1.
Figure 16:
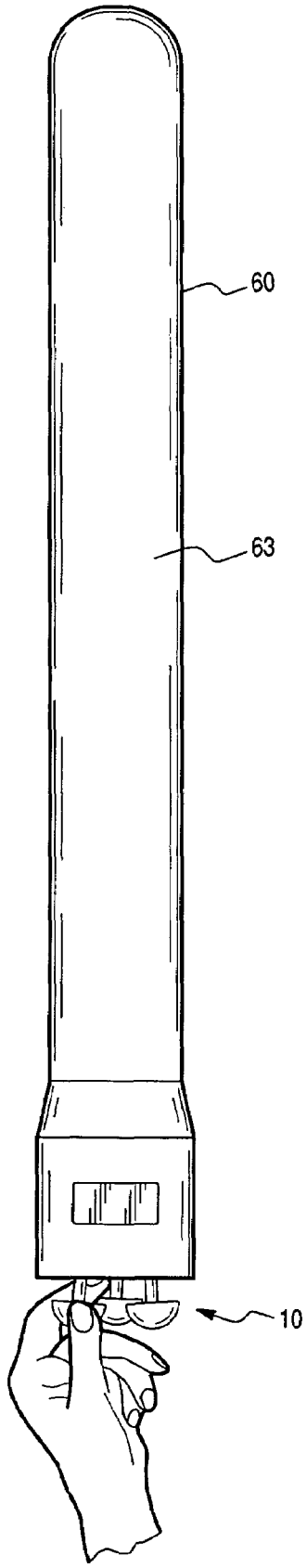
FIG. 16 is a front view of the container for the folding sign of FIG. 1.
Figure 17:
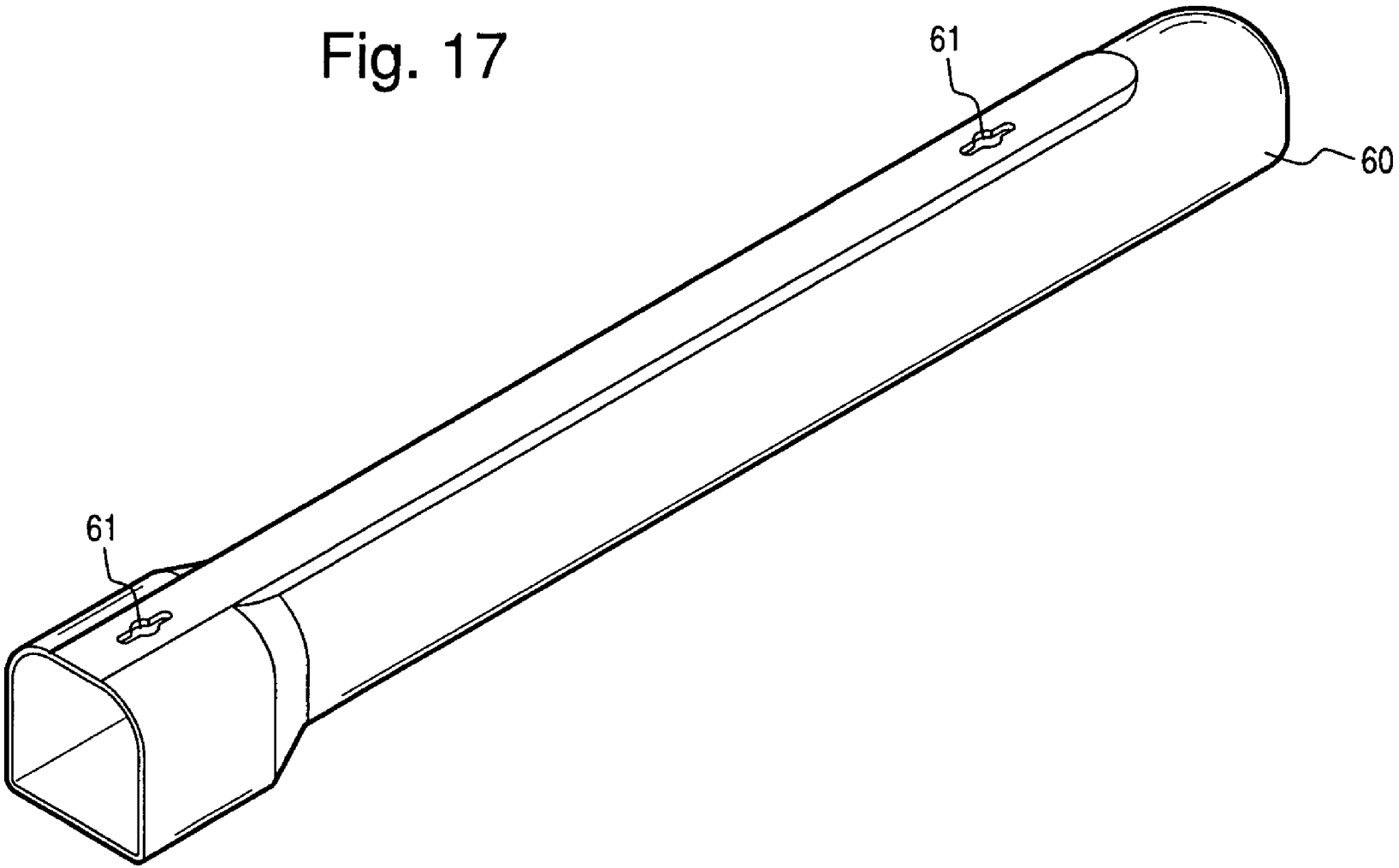
FIG. 17 is a perspective view of the container for the folding sign of FIG. 1.

The folding sign 10 can further include connecting mechanisms 50 that connect the flexible cover 20 to the supporting device 30. The connecting mechanisms 50 also can enable the connection to release, thereby permitting the supporting device 30 to move into the collapsed position. As shown in FIGS. 13 and 13A, when the folding sign is in the open position, the flexible cover 20 extends over the top ends of the legs 31 of the supporting device 30 and is connected to the lower ends of the legs 31 by the connecting mechanisms 50. Each connecting mechanism 50 preferably includes a ring 221 and a protrusion 222. Each ring 221 preferably is a plastic ring with a star shaped negative space that forms tabs that flex. The rings 221 are affixed to the flexible cover 20 at its lower corners, and one protrusion 222 is located on the lower end of each leg 31. When the folding sign 10 is in the open position, each ring 221 is secured over a corresponding leg 31 (preferably about ¼ to ⅜ inch from the end of the leg 31) and held in this location at a desirable tension by a small protrusion 222 on the leg 31 as shown in FIG. 8. In this manner, the connecting mechanisms 50 inhibit movement of the supporting device 30 into the collapsed position. Upon application of a predetermined force to the top of the folding sign 10, the sign 10 moves toward the collapsed position. As the folding sign 10 collapses, each ring 221 equally travels up a respective leg 31, moving the flexible cover 20 with it, as illustrated in FIG. 3. Upon application of a predetermined force to the top of the folding sign 10, the legs 31 rotate up about 60 degrees and the ring 221 moves over protrusion 222 such that the connecting mechanisms 50 frees the flexible cover 20 from the base of legs 31, enabling the flexible cover 20 to slide up the legs 31 as the folding sign 10 collapses.

The connecting mechanisms 50 can, of course, take other forms. For example, they can be formed as VELCRO members 22 that are fixed about the legs 31. The connecting mechanisms 50 can also be formed as snap members.

Figure 11:
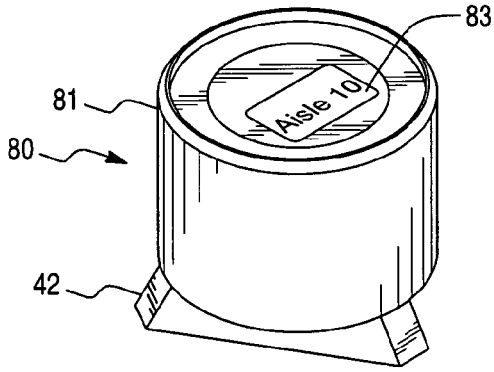
FIG. 11 is a perspective view of portions of the folding sign of FIG. 1.
Figure 12:
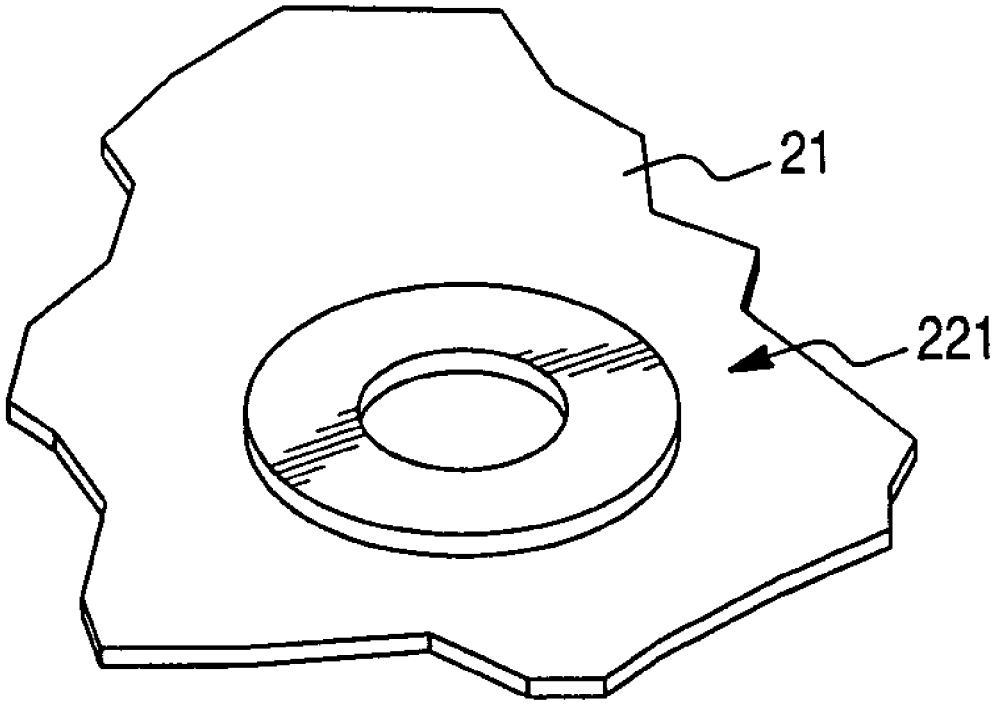
FIG. 12 is a perspective view of portions of the folding sign of FIG. 1.

The folding sign 10 may further include a handle 80. The handle 80 facilitates carrying of the folding sign 10. For example, the handle 80 can be grasped by a user in order to carry the folding sign 10 to a designated location or to reposition the folding sign 10. As shown in FIG. 7, the handle 80 preferably includes a handle piece 81 and a handle bolt 82, which secures the handle piece 81 to the block 42. The handle piece 80 can also be attached to the block 42 by other attachment means. For example, it could be attached by providing a molded-in detail in the handle piece 81 and providing a feature in the block 42 that accommodates the detail. The handle piece 80 also could be integral with the block 42. The handle 80 is preferably positioned at the top of the folding sign 10, which reduces the amount of bending over to reach it. Although the flexible cover 20 can cover the supporting device 30 and the folding mechanism 40, the handle 80 is preferably left exposed. The handle 80 can additionally include an informational area for displaying information. Preferably, the handle 80 has a top surface 83, as shown in FIG. 11, upon which a user can write information. For example, a user may write a grocery store aisle number, thus allowing an employee to return the folding sign 10 to its designated aisle.

A container 60 can also be provided to store the folding sign 10 when the sign is in the closed or folded position. When folded, the sign 10 can be inserted into the container 60. The sign 10 is preferably held in the container 60 by friction between the sign 10 and the container 60. As shown in FIGS. 14 through 17, the container 60 is preferably a hanging tube. The container 60 can have connection slots 61 for mounting the container 60 on a surface, such as a wall, using conventional mounting hardware. For example, the container 60 can be hung in the aisle of a grocery store or on a vertical leg of a cleaning cart or a stocking cart. When it is necessary to deploy the folding sign 10, the sign can be pulled from the container 60, for example, by tugging on legs 31. Alternatively, a pull strap (not shown) could be provided on the folding sign 10 to facilitate removal of the folding sign 10 from the container 60. A surface 63 can also be provided on the container upon which a user can write information, such as a grocery store aisle number. The surface 63 is preferably a front, flat, full-length surface. The information display surfaces 83 and 63 on the handle 80 and container 60 enable a user to mark the folding sign 10 and the container 60 with location-identifying information so that a user can easily identify the proper location of the folding sign 10 and return it to its designated storage container 60.

The folding sign 10 can be used with the storage container 60 in a manner that allows the folding sign 10 to be returned to an appropriate location. The storage container 60 can be associated with a location (such as a pole in a spill-prone area of a grocery store aisle). The folding sign 10 associated with the storage container 60 can have an area for displaying location-identifying information, such as surface 83. Information identifying the location of the storage container 60 can be displayed on that area of the folding sign 10. An employee responding to a hazard in the area can quickly retrieve and deploy the folding sign 10. If the deployed sign 10 is pushed away from the spill by, for example, passersby or grocery carts, the location-identifying information displayed on the folding sign can be used to return the sign to the appropriate location and storage container.

The storage container 60 also can be provided with an area for displaying location-identifying information, such as surface 63. Information identifying the location (such as a grocery store aisle number) can be displayed on that area of the storage container 60. If a storage container 60 that is attached to a pole on a grocery store aisle or to the leg of a cleaning cart becomes detached from the pole or the cart, the location-identifying information displayed on the storage container 60 can be used to return the container 60 to the appropriate location.

Other embodiments of the invention will be apparent to those skilled in the art from consideration of the specification and practice of the invention disclosed herein. It is intended that the specification and examples be considered as exemplary only.

What is claimed is:

1. A folding sign comprising:

a flexible cover having at least one surface for displaying information;

a supporting device for supporting the flexible cover, wherein the supporting device includes at least two support members that can be moved away from one another to a collapsed position;

at least one connecting mechanism that connects the flexible cover to the supporting device, wherein the at least one connecting mechanism is configured to permit the connection to release to allow the supporting device to move to the collapsed position; and wherein the supporting device is configured to move between a closed position and an open position, and further comprising a folding mechanism that permits movement of the supporting device from the open position to the closed position and permits movement of the supporting device to the collapsed position upon application of a predetermined force to the sign.

2. The folding sign of claim 1, wherein the flexible cover includes a sheet of material.

3. The folding sign of claim 1, wherein the surface displays information that warns of a hazard.

4. The folding sign of claim 1, wherein the supporting device includes a plurality of elongated support members.

5. The folding sign of claim 1, wherein the at least one connecting mechanism inhibits movement of the supporting device to the collapsed position.

6. The folding sign of claim 1, wherein the folding mechanism biases the supporting device toward the open position.

7. A folding sign comprising:

a flexible cover having at least one surface for displaying information;

a supporting device for supporting the flexible cover, wherein the supporting device can be moved to a collapsed position; and at least one connecting mechanism that connects the flexible cover to the supporting device, wherein the at least one connecting mechanism is configured to permit the connection to release to allow the supporting device to move to the collapsed position, wherein the supporting device is configured to move between a closed position and an open position, and further comprising a folding mechanism that permits movement of the supporting device from the open position to the closed position and permits movement of the supporting device to the collapsed position upon application of a predetermined force to the sign, wherein the supporting device includes a plurality of elongated support members, and wherein the flexible cover extends over first end portions of the elongated support members and a plurality of connecting mechanisms connect the flexible cover to second end portions of the elongated support members when the supporting device is in the open position.

8. The folding sign of claim 7, wherein at least one of the plurality of elongated support members includes a protrusion at the second end portion of the elongated support member, and the corresponding connecting mechanism includes a ring extending around the elongated support member and configured such that the ring can move along the elongated support member and past the protrusion only after application of the predetermined force.

9. A folding sign comprising:

a flexible cover having at least one surface for displaying information;

a supporting device for supporting the flexible cover, wherein the supporting device can be moved to a collapsed position; and at least one connecting mechanism that connects the flexible cover to the supporting device, wherein the at least one connecting mechanism is configured to permit the connection to release to allow the supporting device to move to the collapsed position, wherein the supporting device is configured to move between a closed position and an open position, and further comprising a folding mechanism that permits movement of the supporting device from the open position to the closed position and permits movement of the supporting device to the collapsed position upon application of a predetermined force to the sign, wherein the supporting device includes a plurality of elongated support members, and wherein the folding mechanism includes a block member and a plurality of coil springs, wherein each coil spring is configured to be displaced in a latitudinal direction, a first end of each of the plurality of coil springs being connected to the block member and a second end of each of the plurality of coil springs being connected to a respective one of the plurality of elongated support members.

10. The folding sign of claim 9, wherein the folding mechanism is configured such that a force applied to the folding sign causes the coil springs to be displaced in a latitudinal direction, thereby allowing the elongated support members to move to the collapsed position.

11. A folding sign comprising:

a flexible cover having at least one surface for displaying information;

a plurality of support members for supporting the flexible cover; and a folding mechanism including a block member and a plurality of coil springs that are each connected to a corresponding support member, wherein the coil springs each include coils that are coiled about a respective longitudinal axis, a first end of each of the plurality of coil springs is connected to the block member, and a second end of each of the plurality of coil springs is connected to a respective one of the plurality of support members, wherein each coil spring is configured to be displaced in a latitudinal direction such that at least some of the coils move apart from one another to permit movement of the support members from an open position to a closed position and to permit movement of the support members to a collapsed position upon application of a predetermined force to the sign.

12. The folding sign of claim 11, wherein the coil springs bias the support members toward an open position.

13. The folding sign of claim 11, wherein the flexible cover includes a sheet of material.

14. The folding sign of claim 11, wherein the surface displays information that warns of a hazard.

15. The folding sign of claim 11, wherein the support members hold the flexible cover such that the flexible cover has an apex portion, and the flexible cover includes a shield positioned on at least part of the apex portion.

16. The folding sign of claim 11, wherein the flexible cover extends over first end portions of the support members and a plurality of connecting mechanisms connect the flexible cover to second end portions of the support members when the support members are in the open position.

17. The folding sign of claim 11, wherein the folding mechanism is configured such that a force applied to the folding sign causes the coil springs to be displaced in a latitudinal direction, thereby allowing the support members to move to the collapsed position.

18. A folding sign comprising:

a flexible cover having at least one surface for displaying information;

a plurality of support members for supporting the flexible cover; and a folding mechanism including a block member and a plurality of coil springs that are each connected to a corresponding support member, wherein a first end of each of the plurality of coil springs is connected to the block member and a second end of each of the plurality of coil springs is connected to a respective one of the plurality of support members, wherein each coil spring is configured to be displaced in a latitudinal direction to permit movement of the support members from an open position to a closed position and to permit movement of the support members to a collapsed position upon application of a predetermined force to the sign, wherein the flexible cover extends over first end portions of the support members and a plurality of connecting mechanisms connect the flexible cover to second end portions of the support members when the support members are in the open position, and wherein at least one of the plurality of support members includes a protrusion at the second end portion of the support member, and the corresponding connecting mechanism includes a ring extending around the support member and configured such that the ring can move along the support member and past the protrusion only after application of the predetermined force.

19. A folding sign comprising:

a flexible cover having at least one surface for displaying information;

a plurality of support members for supporting the flexible cover; and a folding mechanism including a block member and a plurality of coil springs that are each connected to a corresponding support member, wherein a first end of each of the plurality of coil springs is connected to the block member and a second end of each of the plurality of coil springs is connected to a respective one of the plurality of support members, wherein each coil spring is configured to be displaced in a latitudinal direction to permit movement of the support members from an open position to a closed position and to permit movement of the support members to a collapsed position upon application of a predetermined force to the sign, wherein the connecting mechanisms inhibit movement of the support members to the collapsed position.

20. A folding sign comprising:

a flexible cover having at least one surface for displaying information;

a supporting device for supporting the flexible cover; and a handle that facilitates carrying of the folding sign, wherein the handle is disposed at a top of the folding sign and includes an informational area for displaying information, and wherein the handle further includes a device configured to be grasped by a hand and a screw for attaching the device to the folding sign.

21. A method of using a folding sign, comprising:

providing a folding sign having an area for displaying location-identifying information;

providing a storage container into which the folding sign can be inserted for storage;

associating the storage container with a location;

associating the folding sign with the storage container;

displaying information identifying the location on the area of the folding sign; and wherein the storage container has an area for displaying location-identifying information, and further comprising displaying information identifying the location on the area of the storage container.

* * * * *